US005186499A

United States Patent [19]

Mason

[11] Patent Number: 5,186,499

[45] Date of Patent: Feb. 16, 1993

[54] ERASABLE VIDEO CASSETTE LABEL KIT

[75] Inventor: Kenneth C. Mason, Westminster, Colo.

[73] Assignee: Magic Label Corporation, Westminster, Colo.

[21] Appl. No.: 727,752

[22] Filed: Jul. 9, 1991

[51] Int. Cl.[5] ..... B42D 15/00

[52] U.S. Cl. ..... 283/81; 40/124.1; 206/461

[58] Field of Search ..... 283/81, 70; 40/124.1; 206/232, 387, 461, 472

[56] References Cited

U.S. PATENT DOCUMENTS

| | | | |
|---|---|---|---|
| 3,854,229 | 12/1974 | Morgan | 283/81 X |
| 3,925,584 | 12/1975 | Suzuki et al. | 283/81 X |
| 4,501,396 | 2/1985 | Tomsyck et al. | 253/81 X |
| 4,507,883 | 4/1985 | Tarrant | 283/81 X |
| 4,757,901 | 7/1988 | Woods | 283/81 X |
| 4,813,711 | 3/1989 | Bohlman | 283/81 |
| 5,040,296 | 8/1991 | Yerger | 30/81 |

*Primary Examiner*—Paul A. Bell
*Attorney, Agent, or Firm*—Francis A. Sirr; Earl C. Hancock

[57] ABSTRACT

An erasable video cassette labeling kit is disclosed having an elongated paper board base member on which an elongated, transparent, plastic bubble is laminated, the bubble being located to one side of the base member and extending parallel to the major axis of the base member. A stack of individual, elongated, erasable video cassette labels are loosely housed in the bottom of the plastic bubble, adjacent to the base member, and a marking pen is loosely housed in the bubble, on top of the stack of labels. A hanging notch is formed in one end of the base member, in alignment with the center of gravity of the kit, so that the kit can be hung from the notch with the major axis of the base member extending vertically. The labels are formed of four layers comprising a top layer or film of clear polypropylene that is adapted for marking by use of the marking pen, a white, tear resistant, vinyl polymer layer or film, a pressure sensitive adhesive layer or film, and a split, peelable, paper support layer or liner. In use the kit is opened by separating the bubble from the base member, a label is then prepared by removing the paper liner therefrom, the label is then affixed to a video cassette, and the label's polypropylene layer is marked using the pen. The label can be erased manually by the use of means such as a paper tissue, but is smudge resistant when touched. The marking pen is a porous felt tip pen having a dry erase ink that contains pigments, vinyl resin, release agent, methyl isobutyl keytone and n-butyl acetate.

5 Claims, 1 Drawing Sheet

ERASABLE VIDEO CASSETTE LABEL KIT

FIELD OF THE INVENTION

This invention relates to the field of printed matter, and more specifically to identifier labels such as video cassette identifier labels.

BACKGROUND OF THE INVENTION

The wide spread use of video cassette recorders has generated the need for an improved reusable, i.e. erasable, video cassette label kit.

As is well known, the plastic back side surface and the plastic top surface of conventional VHS and Beta video cassettes are provided with a flat area by which paper identifier labels can be adhesively attached to the cassette. In use, the name of the cassette's magnetically recorded video program is written or typed onto the labels. When the cassette is reused, to record a different video program, it is necessary to either erase the labels, or replace the labels with unused labels. Only when the label has been written in pencil, or the like, can the label be erased and reused. Such reuse is usually limited by the incremental amount of physical or structural damage that occurs to the label during each such erasure.

The use of adhesively attached labels on various articles is known. U.S. Pat. No. 4,501,396, for example. shows a time remaining gage label for such a cassette, and U.S. Pat. No. 4,507,883 shows a three part label for a diskette. The use of multilayer tapes and labels is known. U.S. Pat. No. 3,925,584, for example, shows a four layer sealing tape that is constructed so as to prevent tampering, and U.S. Pat. No. 3,854,229 shows a laminated data carrying label.

The art has provided erasable label kits. U.S. Pat. No. 4,757,901 is an example. This patent describes a no-top coated polyester film label that is written by the use of a dry-erase pen, and is erased by the use of a polyester pile fabric eraser.

While prior labels, labeling kits, and labeling devices have been generally useful for their intended purpose, the need remains in the art for an improved video cassette label and labeling kit that is frequently dry-erasable, without the use of special eraser devices, and with no appreciable damage occurring to the label with each dry erasure event.

SUMMARY OF THE INVENTION

The present invention provides an improved video cassette label and labeling kit having multilayer plastic labels that are frequently dry erasable, using a conveniently available erasure means such as a paper tissue rather than a special erasing device, and in which no appreciable damage occurs as a result of a dry erasure event.

The adhesively attached labels of the invention include a top layer of transparent polypropylene. A dry erase pen is used to mark this top layer with darkly colored dry erase ink. A white vinyl layer is positioned immediately under the polypropylene layer. This vinyl layer, usually white, provides high viewing contrast for data that is written on the polypropylene layer. The vinyl layer is also tear resistant, so as to facilitate removal of the label, if desired.

More specifically, the present invention provides an erasable video cassette label and labeling kit that is carried by an elongated, rectangular, and generally rigid paperboard base member. This base member has a vertically extending, centrally located, major axis and an orthogonal minor axis. An elongated, rectangular, and optically transparent plastic bubble member is adhesively attached to the base member on one side of its major axis. The bubble member also has a vertically extending and centrally located major axis that extends generally parallel to the major axis of the base member, and also has an orthogonal minor axis that extends generally parallel to the base member's minor axis.

A stack of individually separate, rectangular, elongated, dry erasable, video cassette labels are loosely housed or stacked in the bottom of the bubble member, adjacent to and in physical contact with the base member. The labels also have a centrally located major axis, and this major axis is positioned generally parallel to the major axis of the bubble member.

An elongate, generally cylindrical, dry erasable, marking pen is loosely housed in the bubble member, on top of the stack of labels, the marking pin having a cylindrical axis that is positioned generally parallel to the major axis of the bubble member.

In accordance with a feature of the invention, each individual and flexible label includes four layers, namely, a thin top layer of transparent polypropylene for marking by the use of the marking pen, a thin, light color, vinyl polymer layer under the polypropylene layer, a thin pressure sensitive adhesive layer under the vinyl polymer layer, and a thin disposable paper support liner under the adhesive layer.

While not critical to the invention, each of the labels is lightly colored, for example colored a shade of white, and the pen contains a dark ink of a highly contrasting color, for example black.

In accordance with a feature of the invention, the top end of the paper base member is provided with an open slot that extends generally parallel to the base member's minor axis, and a notch is formed in the top edge of this slot, in alignment with the center of gravity of the labeling kit, so as to facilitate hanging the kit form a peg, the major axes of the various components thereof extending vertically.

The invention provides combination for marking of a video cassette, the combination comprising a porous tip marking pen containing a dry erase ink formulated of one or more marking pigments, vinyl resin, one or more additives and release agents, n-butyl acetone and methyl isobutyl ketone, and a four layer, erasable, video cassette label having (1) a top polypropylene layer for marking by the use of the marking pen, (2) a vinyl polymer layer immediately under the polypropylene layer, (3) a pressure sensitive adhesive layer immediately under the vinyl polymer layer, and (4) a discardable paper support liner immediately under the adhesive layer.

As a feature of the invention the marking pen is a felt tip pen.

These and other features and advantages of the invention will be apparent to those of skill in the art upon reference to the following detailed description, which description makes reference to the drawings.

DETAILED DESCRIPTION OF THE INVENTION

Figure 1:
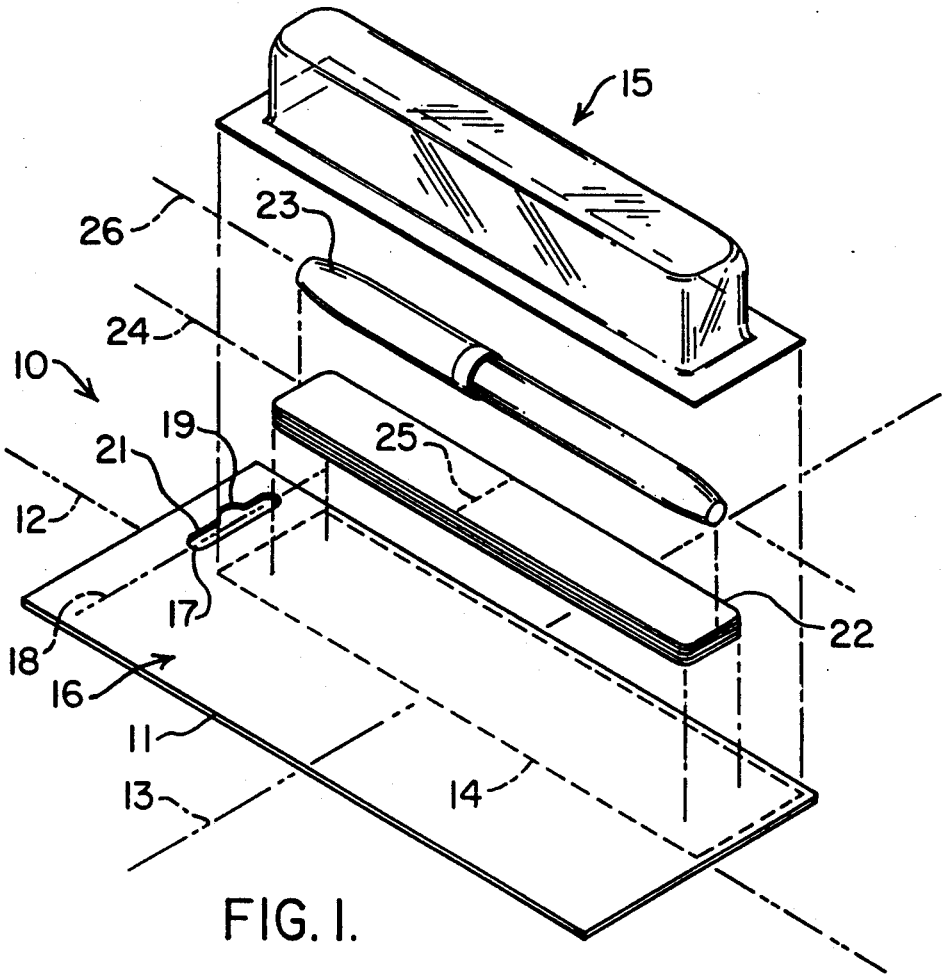
FIG. 1 is an exploded view of the erasable video cassette label kit of the invention.

FIG. 1 is an exploded view of an erasable video cassette label kit 10 in accordance with the invention.

Reference numeral 11 identifies the kit's paperboard base member. Base member 11 is formed as a flat, elongated rectangle, having a major axis 12 and a minor axis 13. While not critical to the invention, base member is about 18.8 cm long, about 7.0 cm wide, and is formed of paperboard about 0.1 cm thick.

Dotted outline 14 shows the right hand surface portion of base member 11 that is devoted to the adhesive mounting of a pan-shaped, optically transparent, bubble member 15. The left hand surface portion 16 of base member 11 contains a printed description (not shown) of the label kit and of its use. The upper surface portion of base member 11 contains a rectangular shaped thruslot or hole 17, having a major axis 18 that extends generally parallel to minor axis 13, and having a minor axis that is generally coincident with and parallel to major axis 12.

A hanging notch 19 is formed in the upper edge 21 of slot 17, in a position to allow kit 10 to hang from a pin (not shown) with its major axis 12 extending vertically.

Reference numeral 22 identifies a stack 22 of erasable labels, for example ten individual labels, that are loosely contained or trapped within bubble member 15 once the bubble member is secured to the outlined portion 14 of base member 11. Each of the individual labels within stack 22 is formed as an elongated rectangle having rounded corners, and having a major axis 24 that extends generally parallel to major axis 12, and a minor axis 25 that extends generally parallel to minor axis 13. As will be apparent, each individual label is formed of a four layer construction comprising polypropylene, vinyl polymer, adhesive and a peel-off backing or liner.

The remaining portion of the cavity within bubble member 15 is occupied by cylindrical shaped, plastic, felt tip pen 23. The cylindrical axis 26 of pen 23 also extends generally parallel to major axis 12.

Pen 23 preferably is a felt tip pen that contains a dark colored dry eraseable ink formulated of pigments, additives and release agents, vinyl resin, n-butyl acetone and methyl isobutyl ketone, and each of the labels within stack 22 are preferably lightly colored, so as to provide a high contrast for data and the like that is hand written on the labels by the use of pen 23. For example each label is colored a shade of white, and the pen's ink is a dark color that highly contrasts to the shade of white.

In a preferred embodiment of the invention pen 23 comprises the commercial product 7001 dry erase marker by Sanford Corporation. This marker is a porous tip ink marking device that is constructed so as to hold its supply of ink within an absorbent material, so that no free liquid is held within the marking device. In use, ink will emerge only through the pen's porous writing nib. The pen has a capacity of not more than 10 grams of ink. The ink comprises the percent by weight formulation 2–5 pigments, 2–5 vinyl resin, 5–10 additives and release agents, 20–30 n-butyl acetone, and 45–60 methyl isobutyl keytone.

Figure 2:
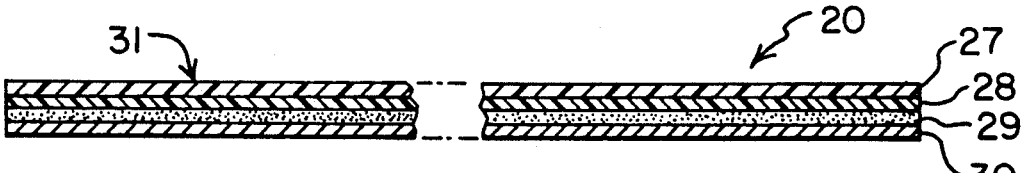
FIG. 2 is an enlarged side view of one of the erasable labels that are contained within the stack of labels shown in FIG, 1, FIG. 2 showing the four layer construction of the label.

In FIG. 2, the various different layers of the label are shown. The topmost layer 27 is a transparent polypropylene layer about 1.0 mil thick. The purpose of this top layer 27 is to provide a top writing surface 31 having a texture which bonds well with the dry erase ink that is contained within pen 23.

The preferred dry erase ink within pen 23 is formulated from pigments, vinyl resin, additives and release agents, n-butyl acetone and methyl isobutyl keytone. This ink, when applied to the top surface 31 of polypropylene layer 27, dries quickly and forms a durable bond with surface 31. Incidental physical contact with dry ink on surface 31 does not smear the ink or rub the ink off surface 31.

On the other hand, the dried ink may easily be manually erased from surface 31 by wiping across surface 31 with a facial tissue or other soft material. Erasure of the ink from surface 31 causes no damage to surface 31. As a result, label 20 may be re-used many times.

Polypropylene layer 27 is bonded to a light colored vinyl polymer layer 28. Layer 28 is about 3.5 mils thick, and is located immediately under layer 27. Vinyl layer is preferably white to provide a background for dark inks that are written on surface 31 of layer 27. Of course, other colors could be chosen for vinyl layer 28, to provide a different appearance and contrast with the ink color that is chosen for marking pen 23.

Immediately under vinyl polymer layer 28 is a pressure adhesive layer 29, preferably composed of SP36 adhesive. The function of adhesive layer 29 is to provide a bonding adhesive for attaching label 20 to an object to be labelled such as a video cassette. A peelable and disposable paper support liner 30 is located under adhesive layer 29. Liner 30 is cut or split for ease of removal, as is well known in the art. Liner 30 simply provides support for label 20 until the label is used, as well as protecting adhesive layer 29. When the label is used, support liner 30, which is for example a 90 pound peelable liner, is peeled off of adhesive layer 29, the label is placed with adhesive layer 29 adjacent to a surface of the object being labelled, and the label is pressed onto the object.

Vinyl layer 28 performs two functions. The first function is to provide a high contrast to the ink contained in pen 23. The second function is apparent when the need arises to remove a label from a video cassette or the like. Vinyl layer 28 is highly tear resistant. Thus, while adhesive layer 29 provides reliable adhesion to an article, the label can be manually removed from an article, and most importantly in one piece, without tearing.

Figure 3:
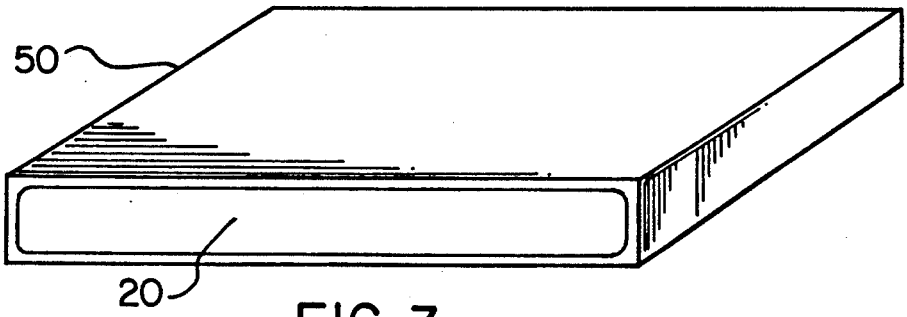
FIG. 3 is a perspective view of a VHS video cassette having one of the labels of the invention adhesively attached to the back edge thereof.

FIG. 3 is a perspective view of a VHS video cassette 50 having a label 20 of the invention adhesively attached to the back edge thereof, this figure also showing the four rounded corners of label 20. While not critical to the invention, the dimensions of label 20 are about 5⅝ inch long and about ¾ inch wide.

The invention has been described in detail while making reference to a preferred embodiment thereof. However, since other embodiments of the invention within the spirit and scope of the invention will be apparent to those of skill in the art, the invention is to be as is defined in the following claims.

What is claimed is:

1. An erasable video cassette labeling kit, comprising; an elongated, rectangular, and generally rigid paperboard base member having a centrally located major axis and an orthogonal minor axis, an elongated, rectangular, and optically transparent plastic bubble member adhesively fixed to said base member on one side of the major axis of said base member, said bubble member having a centrally located major axis that extends generally parallel to the major axis of said base member, and an orthogonal minor axis that extends generally parallel to the minor axis of said base member, a stack of individually separate, rectangular, elongated, erasable video cassette labels loosely housed in the bottom of said bubble member, adjacent to said base member, said labels having a centrally located major axis that is positioned generally parallel to the major axis of said bubble member, each of said labels being of a selected color, said labels being formed of four layers, comprising a top layer of optically transparent polypropylene for marking by the use of a marking pen, a tear resistant and colored vinyl polymer layer immediately under said polypropylene layer, a pressure sensitive adhesive layer immediately under said vinyl polymer layer, and a discardable paper support layer immediately under said adhesive layer, and an elongate, generally cylindrical, marking pen loosely housed in said bubble member, on top of said stack of labels, said marking pin having a cylindrical axis that is positioned generally parallel to the major axis of said bubble member, and said marking pen containing a dry erasable ink of a color that contrasts to the color of said vinyl polymer layer.

2. The labeling kit of claim 1 including;

an elongated, generally rectangular, slot formed in one end of said base member, said slot having a major axis that extends generally parallel to the minor axis of said base member, and having an elongated edge that extends generally parallel to an adjacent edge of said base member, and a notch formed in said slot edge substantially coincident with the center of gravity of said kit when said kit is hung from said notch, with the major axis of said base member extending vertically.

3. The labeling kit of claim 2 wherein said marking pend contains a dark colored dry erasable ink formulated of one or more pigments and release agents, vinyl resin, n-butyl acetone and methyl isobutyl keytone.

4. The video cassette labeling kit of claim 3 wherein the color of said vinyl polymer layer is a shade of white, and wherein said dark colored dry erasable ink highly contrasts to said shade of white.

5. The video cassette labeling kit of claim 4 wherein said marking pen is a porous tip pen.

* * * * *